United States Patent [19]

Chikira et al.

[11] Patent Number: 5,003,274

[45] Date of Patent: Mar. 26, 1991

[54] ELECTROMAGNETIC RELAY

[75] Inventors: Toru Chikira; Yasuyuki Shinbori; Mitsutoshi Kawai; Masahiko Yasuda, all of Yokohama, Japan

[73] Assignee: Jidosha Denki Kogyo Kabushiki Kaisha, Kanagawa, Japan

[21] Appl. No.: 477,387

[22] Filed: Feb. 9, 1990

[30] Foreign Application Priority Data

Feb. 10, 1989 [JP] Japan ..... 1-15204[U]

[51] Int. Cl.[5] ..... H01H 51/22

[52] U.S. Cl. ..... 335/83; 335/78; 335/128

[58] Field of Search ..... 335/78-85, 335/104, 124, 128

[56] References Cited

U.S. PATENT DOCUMENTS 4,048,600 9/1977 Dietrich ..... 335/128

4,460,881 7/1984 Meister et al. ..... 335/128

*Primary Examiner*—Leo P. Picard

*Assistant Examiner*—Lincoln Donovan

*Attorney, Agent, or Firm*—Sughrue, Mion, Zinn, Macpeak & Seas

[57] ABSTRACT

An electromagnetic relay is provided with a movable contact sloped at a prescribed angle relative to an attracted face of an armature and a fixed contact sloped at a prescribed angle relative to an attracting face of a core. In this electromagnetic relay, it is possible to contact the movable and fixed contacts slidingly each other even when the armature is attached so as to be in contact with a frame.

6 Claims, 5 Drawing Sheets

ELECTROMAGNETIC RELAY

BACKGROUND OF THE INVENTION

1. Field Of The Invention

This invention relates to an electromagnetic relay used for working a movable contact and for opening and closing an electric circuit by exciting a coil.

2. Description Of The Prior Art

Heretofore, there has been used an electro magnetic relay as shoen in FIG. 5, for example.

This conventional relay 100 shown in the figure is fixed with terminals 103 and 104 having fixed contacts 101 and 102 facing each other to a base 105 and is fixed to the base 105 with a frame 106 for forming a magnetic path. Said frame 106 is attached with a coil 107 for excitation.

A L-like shaped conductive plate 108 having stiffness is engaged to a projection 106*a* provided on the upper side of the frame 106 in FIG. 5 at one end thereof, and is attached to an armature 109 at another end thereof. The armature 109 is suspended in movable round the one end of the L-shaped plate 108 engaged to the projection 106*a* at the state in which the armature 109 is separated from an end 106*b* of the frame 106 by the plate 108.

A tension spring 110 is engaged between the upper end of the armature 109 and a hook 106*c* provided to the upper end of the frame 106 in the right side in FIG. 5, and said armature 109 is attached with a movable contact 112 through a movable contact plate 111. Said movable contact 112 is disposed so that an extension line A of the armature 109 in the directions of the terminals 103 and 104 may be parallel with extension lines B and B of the terminals 103 and 104 in the direction of the armature 109 approximately. And in this state, the movable contact 112 is so designed as to contact with or discontact from the fixed contacts 101 and 102 provided to the terminals 103 and 104 respectively.

And either end of a wound wire 107*a* of the coil 107 is connected respectively to terminals 113 and 114 fixed to the base 105, and one end of a lead wire 115 is connected to the movable contact plate 111 and another end of the lead wire 115 is connected to a terminal 116 fixed to the base 105.

In an unexcited state of the coil 107 as shown in the figure, the armature 109 is energized in the clockwise direction by elasticity of the tension spring 110 round the one end of the L-shaped plate 108 and the movable contact 112 is in contact with the fixed contact 101 in the left side in FIG. 5, so that the terminal 116 is connected electrically with the fixed contact 101 in the left side in FIG. 5.

In the state, supplying a prescribed electric current to the coil 107 through the terminals 113 and 114 by changing a switch (not shown), magnetic flux is generated by the excitation of the coil 107, so that the armature 109 is attracted rightward in FIG. 5. Thereby, the armature 109 moves rotatively in the anticlockwise direction against the elasticity of the tension spring 110, and the movable contact 112 attached to the armature 109 through the movable contact plate 111 separates from the fixed contact 101 on the left side in FIG. 5 and cones in contact with the fixed contact 102 on the right side in FIG. 5. Accordingly, the terminal 116 of the movable contact 112 is disconnected electrically from the fixed contact 101 on the left side in FIG. 5 and is connected electrically with the fixed contact 102 on the right side in FIG. 5.

And, in this state, intercepting the power supply through the terminal 113 and 114 for the coil 107 by changing the switch (not shown), the coil 107 becomes into unexcited state and discountinues to attract the armature 109. Therefore, the armature 109 moves rotatively in the clockwise direction by the elasticity of the tension spring 110, and so the movable contact 112 separates from the fixed contact 102 on the right side in FIG. 5 and comes in contact with the fixed contact 101 on the left side in FIG. 5. Thereby, said movable contact 112 returns to the state shown in FIG. 5.

Hereupon, said movable contact 112 moves along a line shown with arrow C in FIG. 5. Therefore, when the movable contact 112 comes in contact with the fixed contact 102 on the right side between the respective fixed contacts 101 and 102 shown in FIG. 5, said movable contact 112 comes in contact with said fixed contact 102 in sliding each other by downward displacement of the movable contact 112 together with the movable contact plate 111 because the armature 109 is attracted in the direction of the coil 107 against the elasticity of the tension spring 110 and moves rotatively round the one end of the L-shaped plate 108 in the anticlockwise direction. And, when the movable contact 112 returns to the fixed contact 101 on the left side between the respective fixed contacts 101 and 102 shown in FIG. 5, said movable contact 112 comes in contact with said fixed contact 101 in sliding each other by upward displacement of the movable contact 112 together with the movable contact plate 111 because the arm armature 109 returns in the opposite direction of the coil 107 by the elasticity of the tension spring 110 and moves rotatively round the one end of the L-shaped plate 108 in the clockwise direction. In this manner, said movable contact 112 is so structured as to contact with respective fixed contacts 101 and 102 in sliding each other in order to wipe dust or the like off the contacts and to reduce contact resistance between the contacts (the contact of this kind is called a sliding contact, a wiping contact or a self-cleaning contact).

However, in the above mentioned electromagnetic relay 100, because the armature 109 is designed so as to move rotatively in the clockwise or the anticlockwise direction round the one end of the L-shaped plate 108 by the elasticity of the tension spring 110 through said plate 108 in order to contact the movable contact 112 slidingly with the respective fixed contacts 101 and 102, the L-shaped plate 108 and the tension spring 110 are required for moving the armature 109 rotatively, therefore there is a problem since increase of the parts in number prevents to reduce the cost.

And, the armature 109 is desingned so as to move rotatively round the one end of the L-shaped plate 108 engaged to the projection 106*a* at the state in which the armature 109 is separated from the end 106*b* of the frame 106 by said L-shaped plate 108, therefore there is another problem in that attractive force of the coil 107 for the armature 109 is lost remarkably by the gap existing between the armature 109 and the frame 106.

SUMMARY OF THE INVENTION

The present invention is made in view of the aforementioned problems of the prior art and an object of the invention is to provide an electromagnetic relay which has a movable contact and a fixed contact possible to contact slidingly with each other (that is the so-called sliding contact) in spite of simple structure, and is profitable in respect of the cost and possible to use the attractive force of the coil effecftively.

The construction of the electromagnetic relay according to this invention for attaining the abovementioned object is characterized by having a fixed contact provided on a terminal fastened a base, a movable contact attached to a movable contact plate and for contacting and discontacting with the said fixed contact, an armature provided with the said movable contact plate, a core attached to a frame fixed to the base for attracting said armature and making the movable contact into touch with the fixed contact by excitation of a coil, and the said movable contact being sloped at a prescribed angle to an attracted face of said armature and said fixed contact being sloped at a prescribed angle to an attracting face of the said core.

In the electromagnetic relay according to this invention, the fixed contact is sloped relative to the attracting face of the core and the movable contact is sloped relative to the attracted face of the armature at a prescribed angle respectively, therefore the electromagnetic relay according to this invention is structured so that the movable and the fixed contacts may contact slidingly with each other even when the armature is attached so as to contact with the frame and movably round the upper end thereof without using the L-shaped plate and the tension spring. Accordingly, the cost of said relay decreases and the attractive force loss of the coil also decreases.

DESCRIPTION OF THE PREFERRED EMBODIMENT

Figure 1:
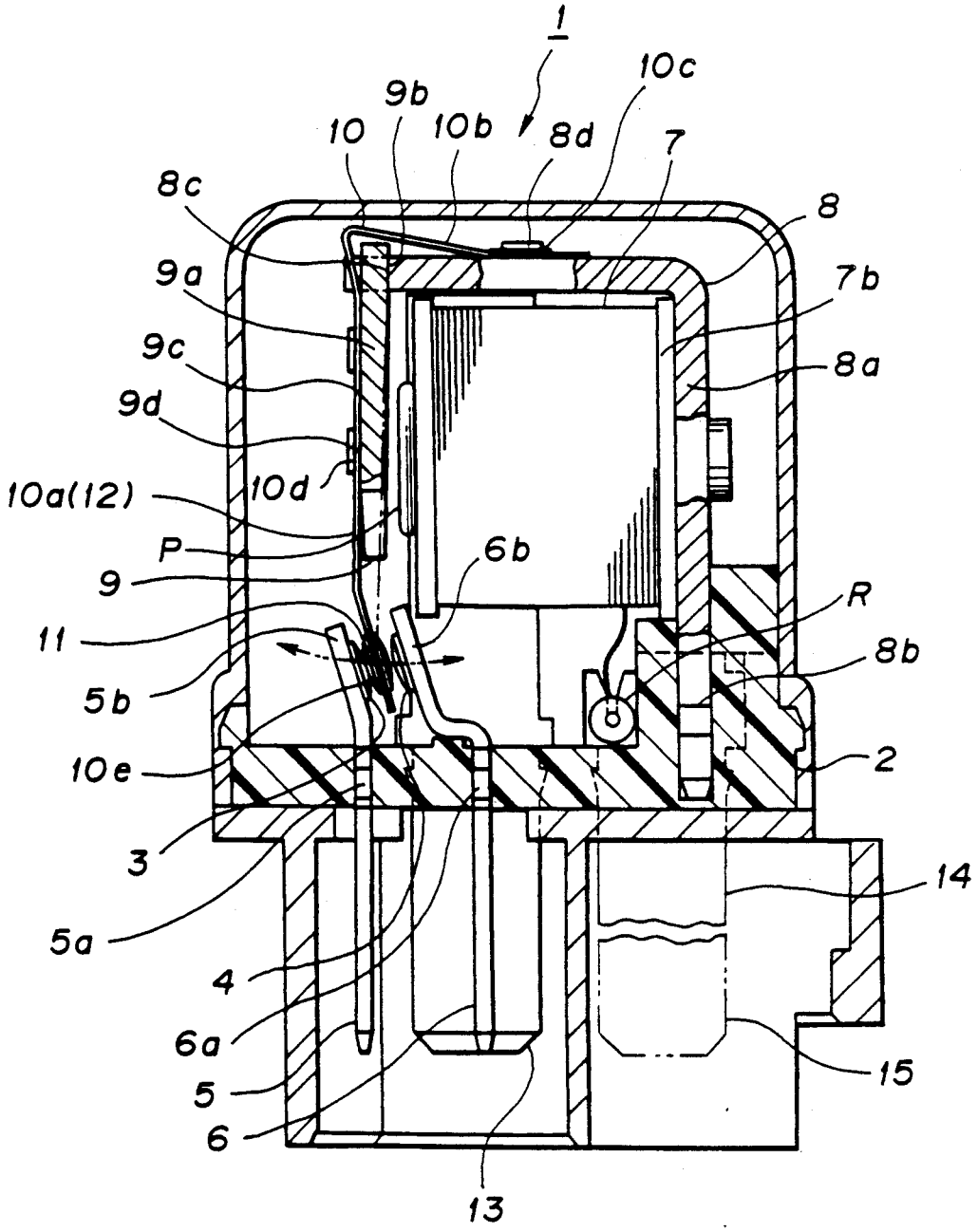
FIG. 1 is a verical sectional side view illustrating the electromagnetic relay according to an embodiment of this invention.

An embodiment of the electromagnetic relay according to this invention will be described below on basis of FIG. 1 and FIG. 2.

An electromagnetic relay 1 shown in the figures is fixed to a base 2 with terminals 5 and 6 provided with fixed contacts 3 and 4 respectively, with a frame 8 attached with a core P of coil 7. An armature 9 is connected rotatably to the frame 8 by an resilient member 10 in the contacted state.

The armature 9 is attached with a movable contact plate 12 (which forms a part of said resilent member 10 in this embodiment) provided with a movable contact 11 for contacting with and discontacting from said fixed contacts 3 and 4, and a terminal 13 connected with said movable contact plate 12 is fixed to the base 2. Either and of a wound wire 7*a* of the coil 7 is connected to terminals 14 end 15 fixed to the base 2 respectively, The terminals 5 and 6 are fixed to the base 2 at the respective fixed parts 5*a* and 6*a* provided in the center thereof in FIG. 1, and the parts lower than said fixed parts 5*a* and 6*a* of respective terminals 5 and 6 protrude downward in FIG. 1 in order to connect to the outside.

And said terminals 5 and 6 are provided with fixed contact-attaching parts 5*b* and 6*b* bent slightly in the leftward direction on the upper side of respective fixed parts 5*a* and 6*a* in FIG. 1, said fixed contact-attaching parts 5*b* and 6*b* are provided with fixed contacts 3 and 4 at the positions facing each other.

The coil 7 is attached to the frame 8 for forming a magnetic path at a part of the core P thereof, and either end of a wire 7*a* wound around a bobbin 7*b* is connected to the terminals 14 and 15 respectively.

Said terminals 14 and 15 are also connected with a resistor R for eliminating a noise at the respective connected parts with said wound wire 7*a*, the coil 7 is excited by supplying a prescribed current to the coil 7 through the terminals 14 and 15.

On the one side, frame 8 is fixed to the base 2 at an attached part 8*b* on the lower side of a frame body 8*a* having an inverted L-shaped section in FIG. 1. Said frame 8 is provided with a beam-shaped supporting part 8*c* for suspending the armature 9 so as to contact with said armature 9 (which will be explained later) at the left end thereof, and with a resilent member-fixing part 8*d* for fixing a frame-side portion 10*b* of the resilient member (which will be explained later) on the right side of said supporting part 8*c* in FIG. 1.

On the other side, the armature 9 has a contacting part 9*b* suspended by the supporting part 8*c* of the upper end of the frame body 8*a* so as to contact with said supporting part 8*c*, and is attached with the resilient member 10 by fixing a movable contact-side portion 10*a* of said resilient member 10 to resilient member-fixing part 9*d* profided on the right side wall 9*c* of an armature body 9*a* in FIG. 1.

Additionally, the resilient member 10 is a plate which has a inverted L-shaped section and some elasticity, and is formed in one united body from the movable contact-side portion 10*a* used as the movable contact plate 12 provided with the movable contact 11 and the frame-side portion 10*b* fixed to the frame 8 in this embodiment.

Said elastic member 10 is attached to the resilent member-fixing part 8*d* provided to the frame 8 at a fitting part 10*c* in the position near to right end of the frame-side portion 10*b* extending rightward in FIG. 1, and attached to the resilent member-fixing part 9*d* provided to said armature 9 at a fitting part 10*d* in the center of the movable contact-side portion 10*a* extending downward in FIG. 1.

And, the resilient member 10 is provided with the movable contact 11 in the poition near to the lower end of the movable contact-side portion 10*a* in FIG. 1 between said fixed contacts 3 and 4, and a movable contact-attaching part 10*e* of the movable contact-side portion 10*a* is bent slightly in the rightward direction in FIG. 1.

Namely, at the state in which the coil 7 is not excited as shown in FIG. 1, the armature 9 is energized in the clockwise direction in FIG. 1 at the state of contacting the contacting part 9*b* thereof with the supporting part 8*c* provided with the frame 8 by the resilient member 10. And the movable contact 11 provided to the movable contact-side portion 10*a* is in contact with the fixed contact 3 between the respective fixed contacts 3 and 4, so that the terminal 13 and the terminal 5 are connected electrically with each other.

Figure 2:
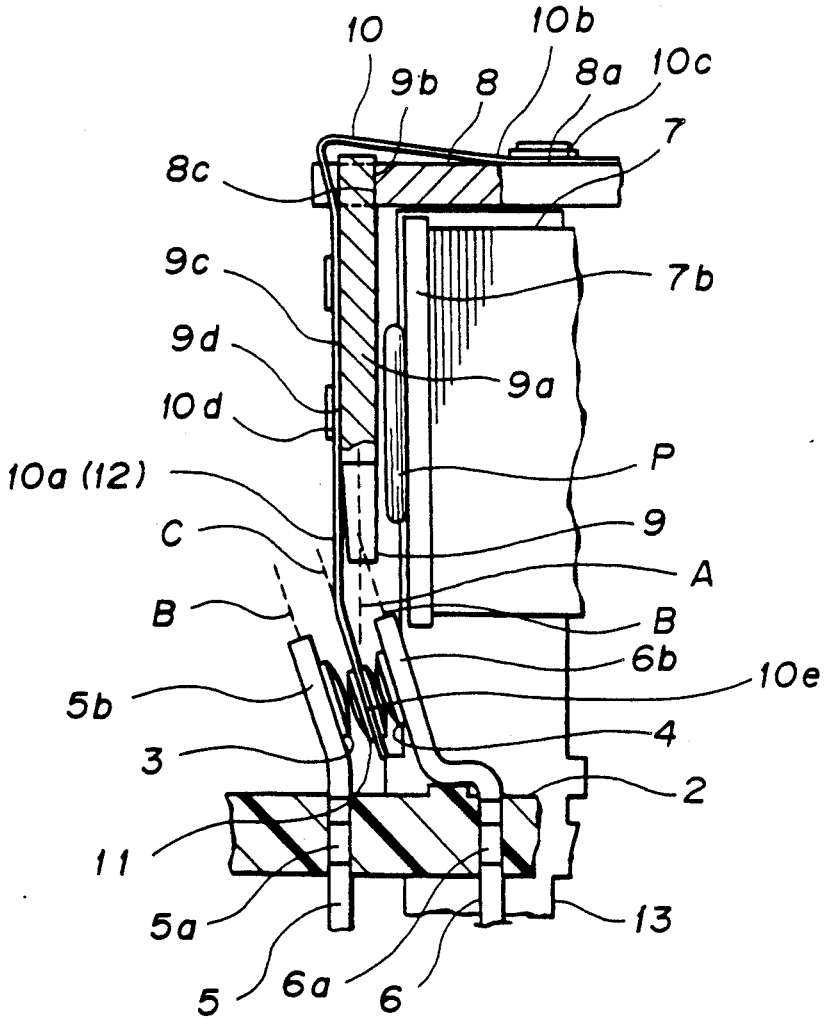
FIG. 2 is an enlarged sectional view illustrating the circumference of the contacts of the electromagnetic relay shown in FIG. 1 at the time of excitation.

Hereupon, as shown in FIG. 2, an extension line A extending toward the respective terminals 5 and 6 from the armature 9 intersects an extension line B extending toward the armature 9 from the fixed contact-attaching parts 5*b* and 6*b* of the respective terminals 5 and 6 and an extension line C extending toward the armature 9 from the movable contact-attaching part 10*e* on the movable contact-side portion 10*a* (movable contact plate 12) of the resilient member 10 at the prescribed angle. Therefore, the fixed contacts 3 and 4 are sloped relative to the attracting face of the core P, and the movable contact 11 is sloped relative to the attracted face of the armature 9.

At the state in which the coil 7 shown in FIG. 1 is not excited, by changing the switch (not shown) and supplying a prescribed electric current to the coil 7 through the terminals 14 and 15, magnetic flux is generated by excitation of the coil 7 and the armature 9 is attracted rightward in FIG. 1.

By the attraction of the armature 9, said armature 9 moves rotatively in the anticlockwise direction in FIG. 1 against the elasticity of the resilient member 10 at the state in which the armature 9 is supported by the supporting part 8*c* provided to the frame 8 at the contact part 9*b*, the movable contact 11 provided to the movable contact-side portion 10*a* (movable contact plate 12) of the resilent member 10 discontacts from the fixed contact 3 between the respective fixed contacts 3 and 4 and contacts with the another fixed contact 4 slidingly each other, so that the movable contact 11 is maintained in the state as shown in FIG. 2.

Thereby, the electrical connection between the terminal 13 connected to the movable contact 11 and the terminal 5 connected to the fixed contact 3 is intercepted and said terminal 13 and the terminal 6 connected to another fixed contact 4 are connected electrically.

And, in this state, intercepting the power supply to the coil 7 through the terminals 14 and 15 by changing the switch (not shown), the coil 7 becomes into unexcited state and discontinues to attract the armature 9. Thereby, the armature 9 returns rotatively in the clockwise direction in FIG. 1 by the elasticity of the resileient member 10, the movable contact 11 discontacts from the fixed contact 4 and contacts with the fixed contact 3 slidingly each other, so that said movable contact 11 returns into the state as shown in FIG. 1.

That is, movable contact 11 contacts with the fixed contact slidingly each other fulfills the function as the so-called sliding contact in the case the movable contact 11 separates from the fixed contact 3 on one side and comes in contact with the fixed contact 4 on the other side, and also in the case the movable contact 11 separates from the fixed contact 4 on the other side and comes in contact with the fixed contact 3 on one side.

Figure 3:
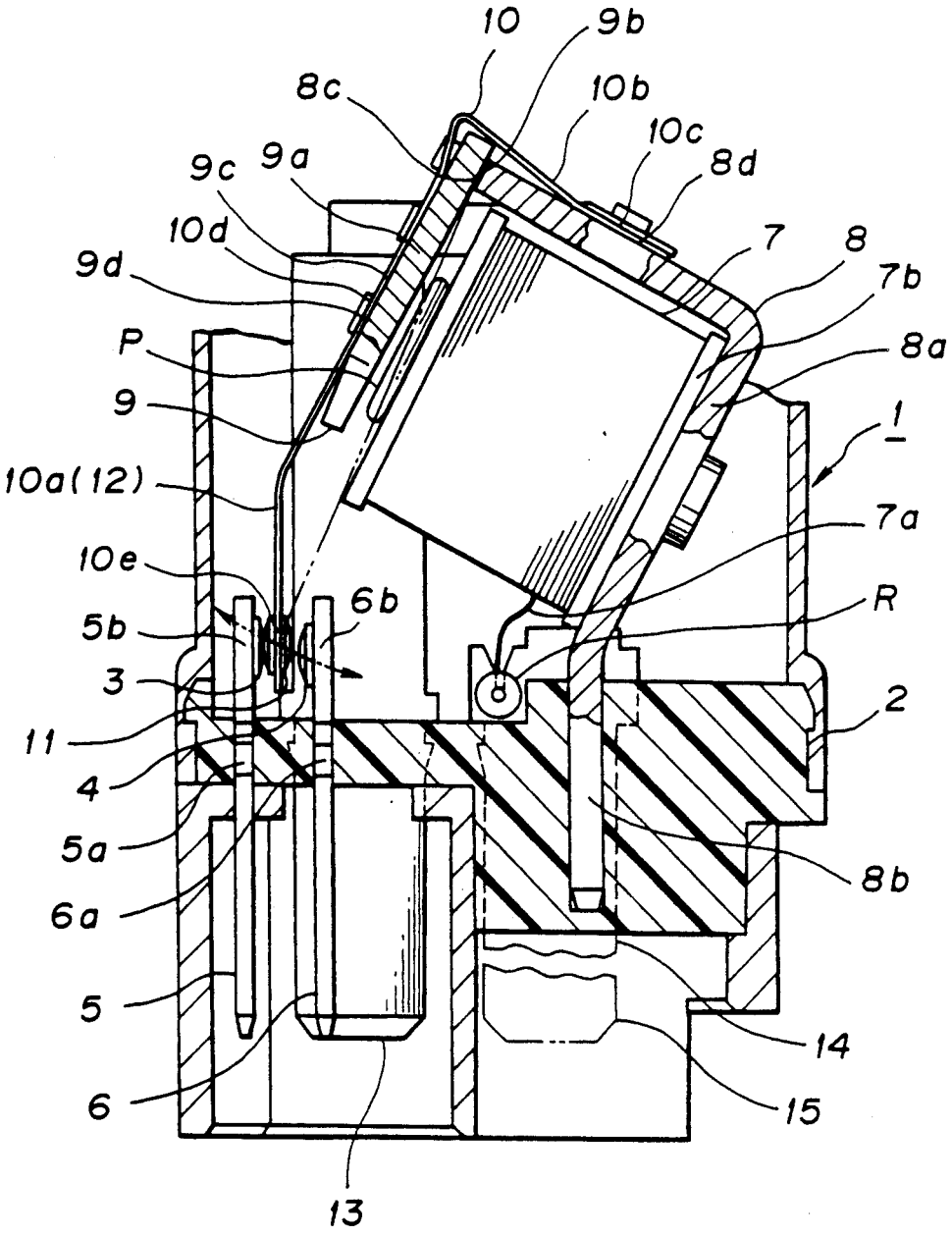
FIG. 3 is a vertical sectional side view illustrating the electromagnetic relay according to another embodiment of this invention.
Figure 4:
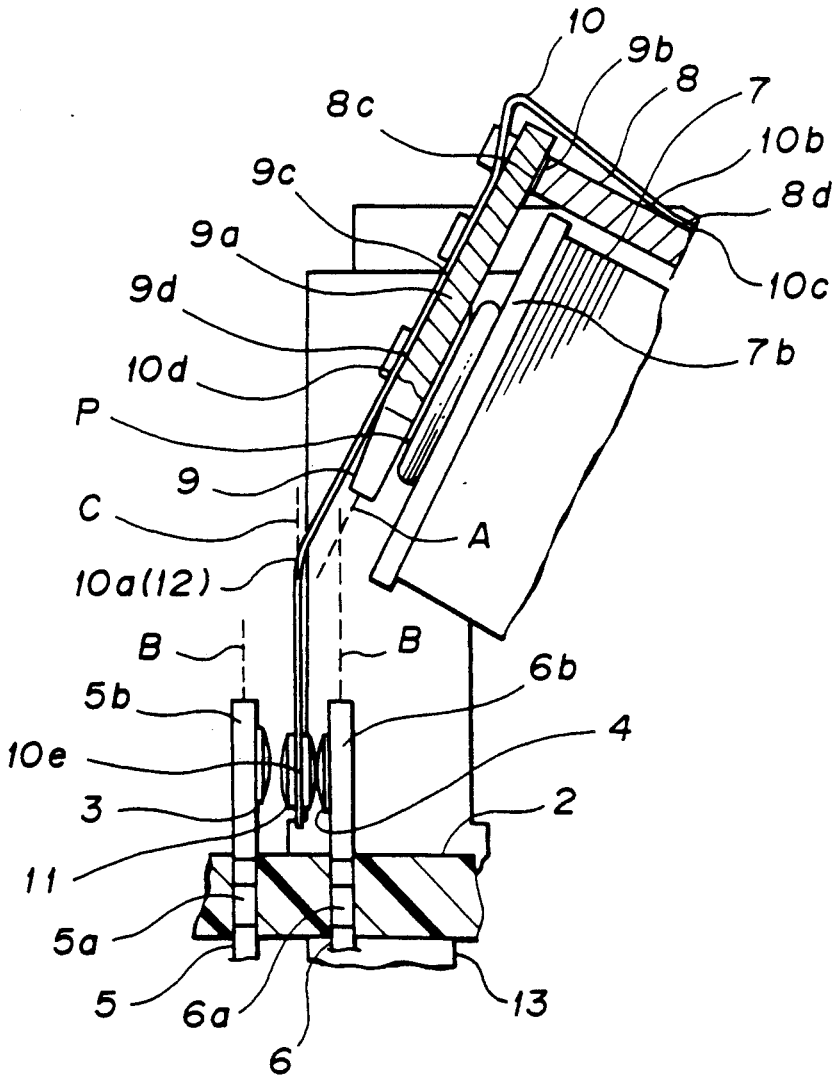
FIG. 4 is an enlarged sectional view illustrating the circumference of the contacts of the electromagnetic relay shown in FIG. 3 at the time of excitation.
Figure 5:
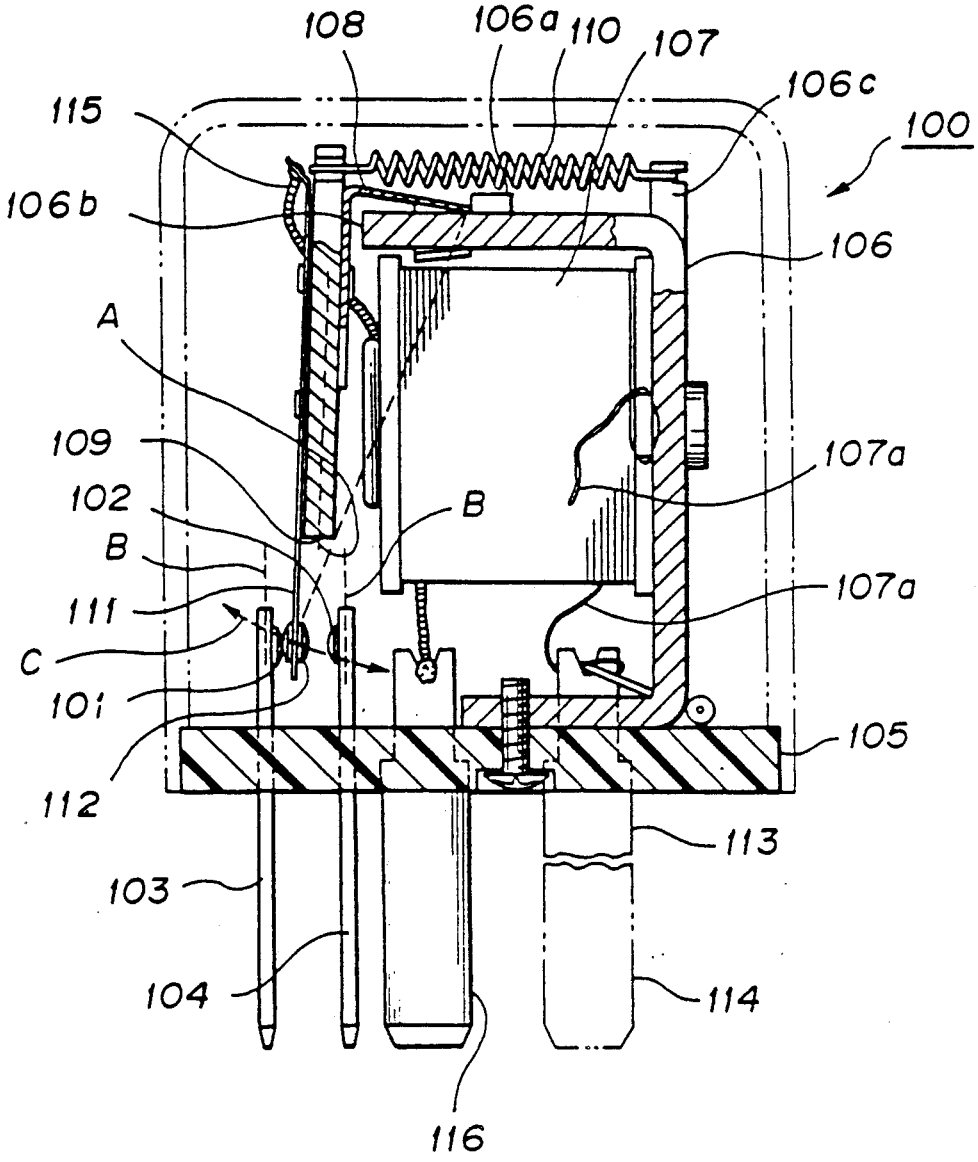
FIG. 5 (PRIOR ART)
FIG. 5 is a vertical sectional view of the conventional electromagnetic relay.

FIG. 3 and FIG. 4 show the electromagnetic relay according to another embodiment of this invention.

The electromagnetic relay 1 in this embodiment is provided with flat-shaped fixed contact-attaching parts 5*b* and 6*b* on the upper side of fixed parts 5*a* and 6*a* of respective terminals 5 and 6, and said respective fixed contact-attaching parts 5*b* and 6*b* are provided with fixed contacts 3 and 4 so as to face each other.

The frame 8 is bent rightward at the upper side of the attached part 8*b* thereof in FIG. 3, and has the same structure as that of the frame 8 shown in FIG. 1 and FIG. 2 except above.

And also in case of this embodiment, as shown in FIG. 4, the extension line A extending toward the respective terminals 5 and 6 from the armature 9 intersects the extension line B extending toward the armature 9 from the fixed contact-attaching parts 5*b* and 6*b* of the respective terminals 5 and 6 and an extension line C extending toward the armature 9 from the movable contact-attaching part 10*e* on the movable contact-side portion 10*a* (movable contact plate 12) of the resilent member 10 respectively at the prescribed angle. Therefore, the fixed contacts 3 and 4 are sloped relative to the attracting face of the core P, and the movable contact 11 is sloped relative to the attracted face of the armature 9.

Thereby, said movable contact 11, in the same manner as that shown in FIG. 1 and FIG. 2, contacts with the fixed contact slidingly each other and fulfills the function as the so-called sliding contact in the case the movable contact 11 separates from the fixed contact 3 on one side and comes in contact with the fixed contact 4 on the other side, and also in the case the movable contact 11 separates from the fixed contact 4 on the other side and comes in contact with the fixed contact 3 on one side.

As described above, the electromagnetic relay according to this invention is provided with a movable contact sloped at a prescribed angle relative to an attracted face of an armature and a fixed contact sloped at a prescribed angle relative to an attracting face of a core. Therefore, it is possible to contact the movable and the fixed contacts slidingly each other even when the armature is attached to the frame so as to be in contact with the frame end and to move rotatively round the upper end thereof without using the L-shaped plate and the tension spring, so that excellent effects are obtained since it is possible to decrease the manufacturing cost and the loss of the attractive force of the coil at the time of the excitation.

What is claimed is:

1. An electromagnetic relay comprising:

a support base;

a frame supported on said base;

a core connected to said frame having an attracting surface;

an armature disposed substantially parallel to said attracting surface and movably attached to said frame by means of a resilient member fixed to said armature and connected to said frame, said resilient member having an end portion having a movable contact thereon, said end portion being disposed at an angle with respect to said attracting surface;

a fixed contact provided on a terminal connected to said base and disposed at an angle with respect to said attracting surface whereby said terminal is disposed parallel to said end portion; and a coil associated with said core adapted to be excited to attract said armature toward said attracting surface;

whereby the movable contact moves toward the fixed contact along a path having a main component substantially perpendicular to said terminal having said fixed contact thereon and a smaller component substantially parallel to said terminal having said fixed contact thereon to provide a wiping action between said movable contact and said fixed contact.

2. An electromagnetic relay as set forth in claim 1 wherein said support base has a substantially planar upper surface and said attracting surface is disposed orthogonal to said upper surface of said support base and said terminal having said fixed contact thereon is disposed at an angle to said upper surface.

3. An electromagnetic relay as set forth in claim 2 wherein said attracting surface is disposed at an angle to said upper surface of said support base while said terminal having said fixed contact thereon is disposed orthogonal to said upper surface.

4. An electromagnetic relay set forth in claim 1 wherein said resilient member is fixed to a surface of said armature having a tapered portion adjacent an end thereof adjacent said movable contact.

5. An electromagnetic relay as set forth in claim 4 wherein said frame is fixed to said base by securing an attachment part provided on said frame into a groove provided in said base.

6. An electromagnetic relay as set forth in claim 1 wherein said movable contact is disposed within a range between an extension of a straight line connecting the end of the armature adjacent the movable contact and a supporting part of said frame and an extension of a straight line connecting an end of the coil adjacent said fixed contact and said supporting part of the frame.

* * * * *